United States Patent [19]

Komura

[11] Patent Number: 5,047,804

[45] Date of Patent: Sep. 10, 1991

[54] IMAGE FORMING APPARATUS HAVING A TONER REPLENISHMENT CONTROL SYSTEM

[75] Inventor: Masaru Komura, Osaka, Japan

[73] Assignee: Minolta Camera Kabushiki Kaisha, Osaka, Japan

[21] Appl. No.: 224,155

[22] Filed: Jul. 26, 1988

[30] Foreign Application Priority Data

Jul. 27, 1987 [JP] Japan ..... 62-188366
Jul. 27, 1987 [JP] Japan ..... 62-188367

[51] Int. Cl.[5] ..... G03G 21/00
[52] U.S. Cl. ..... 355/246
[58] Field of Search ..... 355/200, 204, 206, 245, 355/246

[56] References Cited

U.S. PATENT DOCUMENTS 4,514,480 4/1985 Wada et al. ..... 355/246 X
4,708,458 11/1987 Ueda et al. ..... 355/206
4,720,730 1/1988 Ito ..... 355/246 X
4,758,861 7/1988 Nakamaru et al. ..... 355/246 X
4,786,942 11/1988 Kusumoto et al. ..... 355/246 X

FOREIGN PATENT DOCUMENTS 59-204863 11/1984 Japan ..... 355/246
60-2662 1/1985 Japan .
60-232565 11/1985 Japan ..... 355/246
61-203474 9/1986 Japan .

*Primary Examiner*—Fred L. Braun
*Attorney, Agent, or Firm*—Burns, Doane, Swecker & Mathis

[57] ABSTRACT

An image forming apparatus is provided with a plurality of developing units in which the toner replenishing device equipped with each developing unit is actuated for a predetermined period of time. When toner replenishment cannot be completed at the time when the developing unit has stopped its action, it is arranged so as to either actuate the developing unit and the toner replenishing device for a predetermined time after image formation is carried out or keep the toner replenishing device in action after the developing unit has stopped its operation for a predetermined period of time while at the same time actuating the developing unit for the remaining time of the predetermined time after image formation is carried out.

5 Claims, 7 Drawing Sheets

IMAGE FORMING APPARATUS HAVING A TONER REPLENISHMENT CONTROL SYSTEM

BACKGROUND OF THE INVENTION

The present invention relates to a developing unit for use in an image forming apparatus of electrophotographic copying machines, laser beam printers and the like, and more particularly to a toner replenishing mechanism in a developing unit of image forming apparatus capable of selectively actuating a plurality of the developing units in accordance with an optionally predetermined area set in the direction of action for a single image forming operation.

The present inventor has proposed in his previous Japanese Patent Application No. 21630/1987 an image forming apparatus which is able to form an image having different colors corresponding to an area by selectively actuating a plurality of developing units in accordance with an optionally predetermined area set in the direction of action for a single image forming operation.

In the Japanese Published Examined Patent Application No. 2662/1987, there is disclosed a developing unit which is designed to continue actuating toner replenishing means and stirring means until the toner density reaches a standard value even if copying operation is finished if the toner density is lower than that of the standard value.

In an image forming mode by the image forming apparatus previously disclosed by the present inventor, in which development is made for a predetermined area set by the first developing unit and the rest of the area by the second developing unit during a single operation of image formation, when a toner density short signal is emitted during the developing process by the first developing unit, the toner replenishing motor is actuated, and when developing process is changed from the first developing unit to the second developing unit while toner replenishment occurs, the toner replenishing motor is instantly stopped corresponding with the stoppage of the first developing unit. The invention was developed so as to deal with the problem in which toner replenishing is continued when the first developing unit stopped its action and the replenished toner accumulated at the toner receiving inlet of the developing unit and finally overflows.

Because the first developing unit can not be actuated when the copying machine is changed to the second developing unit, toner replenishing action can no longer be continued as disclosed in Japanese Published Examined Patent Application No. 2662/1987. Accordingly, if the toner replenishment is limited to the time the first developing unit is in action, the toner consumption may exceed the the amount of toner replenished, and it causes a shortage of toner in the developing unit and eventually lowers image density because no function is provided against such problem.

SUMMARY OF THE INVENTION

The main object of the present invention is to provide a developing unit which is able to replenish toner accurately even if the developing unit which is being operated is changed to another developing unit during toner replenishment without creating such problems as overflow of toner and lowering of image density caused by toner shortage.

Another object of the present invention is to provide a developing unit which is able to replenish toner properly by actuating a developing unit after image formation is made even if the development unit is changed to another developing unit and toner replenishment is stopped so that such problems as overflow of toner and lowering of image density caused by toner shortage can be eliminated.

Still another object of the present invention is to provide a developing unit which is able to replenish toner sufficiently and supply the replenished toner uniformly by actuating a developing unit after image formation is made at least for the remaining time of a predetermined time for toner replenishment even if a developing unit is changed to another developing unit and the developing unit has stopped its action while toner replenishment is continued so that such problems as overflow of toner and lowering of image density caused by toner shortage can be eliminated.

Further objects and features of the present invention will be apparent from the following description, reference being had to the accompanying drawings wherein preferred embodiments of the present invention are clearly shown.

BRIEF DESCRIPTION OF THE DRAWINGS

FIG. 1 is a sectional view showing an outline of the whole copying machine.

FIG. 2 is an enlarged view illustrating the structure around the photosensitive drum in FIG. 1.

FIG. 3 is a perspective view showing the principal part of the developing unit in FIG. 2.

FIG. 4 is a transverse sectional view at toner replenishing section of the developing unit in FIG. 3.

FIG. 5 is a schematic plan view of the copying machine in FIG. 1.

FIG. 6 is a schematic elevational view showing a structure for designating color area in the developing unit of the copying machine in FIG. 1.

FIG. 7 is a control circuit diagram.

FIG. 8 is a time chart for movement of each part during 1 scan 2 colors copying mode.

FIG. 9 is a time chart for movement of each part under standard copying mode.

DETAILED DESCRIPTION OF THE INVENTION

An embodiment of the present invention will now be described with reference to the accompanying drawings.

Figure 1:
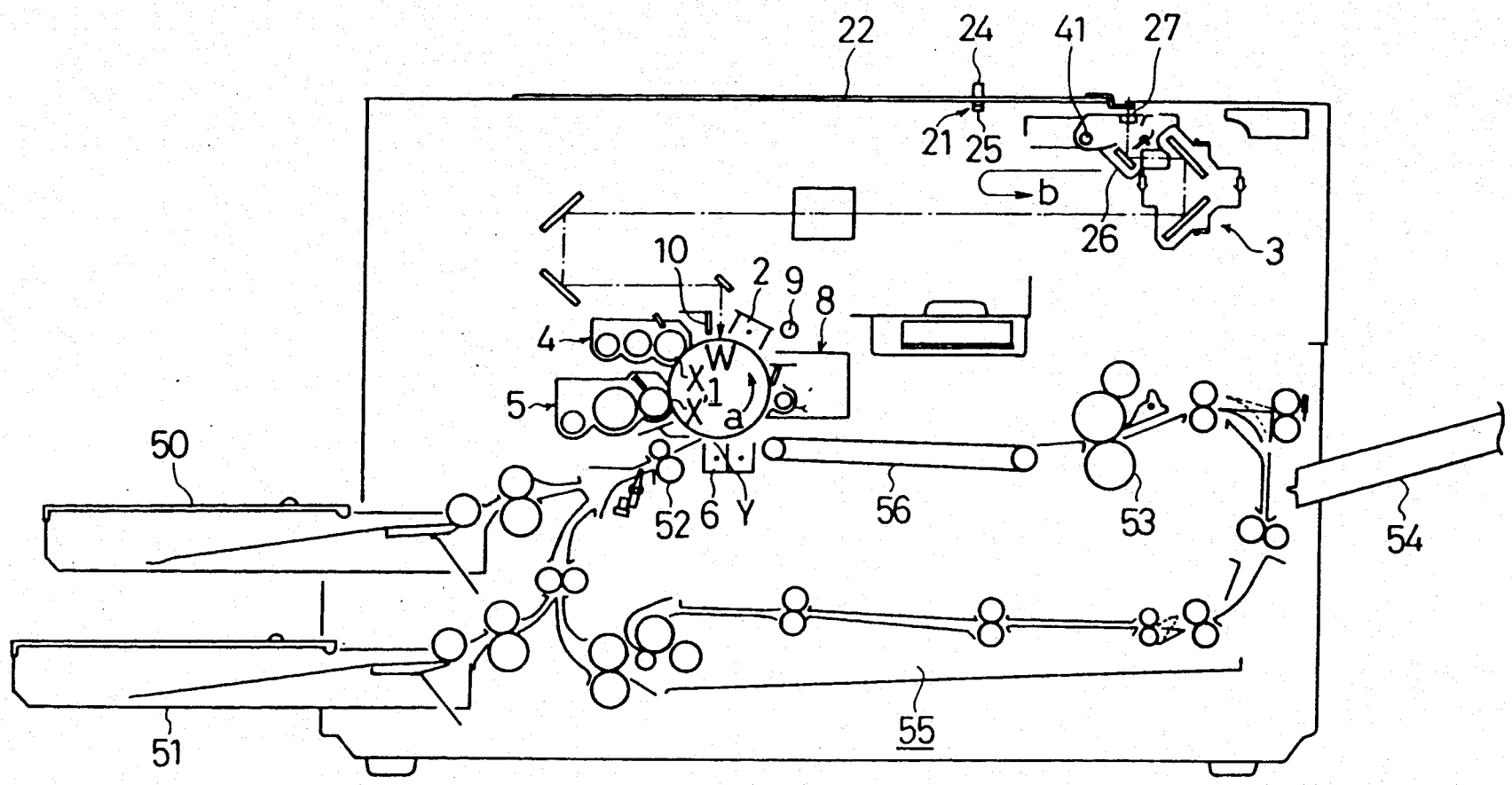
FIG. 1 through 9 illustrate an embodiment of the present invention to which a two-color copying machine capable of forming an image in two assorted colors by using two developing units interchangeably in a single scan operation.

FIG. 1 shows a two-color copying machine as the first embodiment of the present invention. Approximately in the central part of the copying machine, a photosensitive drum 1 is disposed so as to be driven rotatably in the direction of the arrow a. Around the photosensitive drum 1, charger 2, the first and second developing units 4,5, transfer-separation chargers 6, cleaning device 8 and eraser lamp 9 are disposed sequentially in the direction of the arrow a comprising a known image forming section of an electrophotographic system. Designated at 10 is a suberaser.

Under a document support glass 22 disposed on the upper part of the copying machine, a scan type exposure optical system 3 is provided for scanning images of a document placed on the document support glass 22 and returns in the direction indicated by the arrow b after making a slit exposure onto the photosensitive drum 1. The electrostatic latent image of the document is formed on the photosensitive drum 1 by the optical system 3 and is developed by either one of the first developing unit or the second developing unit, or by both of the developing units.

At the lower left side of the copying machine, paper feed sections 50,51 are provided in two decks, and copy papers accommodated in the cassettes that are to be equipped with the paper feed sections 50,51 are selectively fed corresponding to a predetermined size. The paper selected is then transported via timing rollers 52 to transfer section Y which is located between the photosensitive drum 1 and the transfer-separation chargers 6 at a predetermined timing, and the electrostatic latent image on the drum 1 is transferred onto the paper.

A suction type transport conveyor 56 is provided behind the transfer section for transporting the copy paper passed through the transfer section to a fixing device 53. The paper passed through the fixing device 53, after fixing of the transferred image, is thereafter selectively transported either to a discharge tray 54 outside of the copying machine or to the other paper feed tray 55 disposed at the lower portion of the copying machine. In the paper feed tray 55, the copy papers passed through the fixing device are temporarily stacked either in the state of face down wherein the image formed surface faces downward or contrarily in the state of face up wherein the image formed surface faces upward.

When paper accommodation is finished, the copy papers stacked in the tray 55 are transported one by one for another transfer process via timing rollers 52. The copy papers accommodated in the state of face down are fed in the state of face up for another transfer process, thereby receiving another image transfer on the transferred image previously received, thus having composite copying thereon. The copy papers accommodated in the state of face up are fed in the state of face down for another transfer process, thereby receiving image transfer on the other side of paper, thus having bothsided copying.

Figure 2:
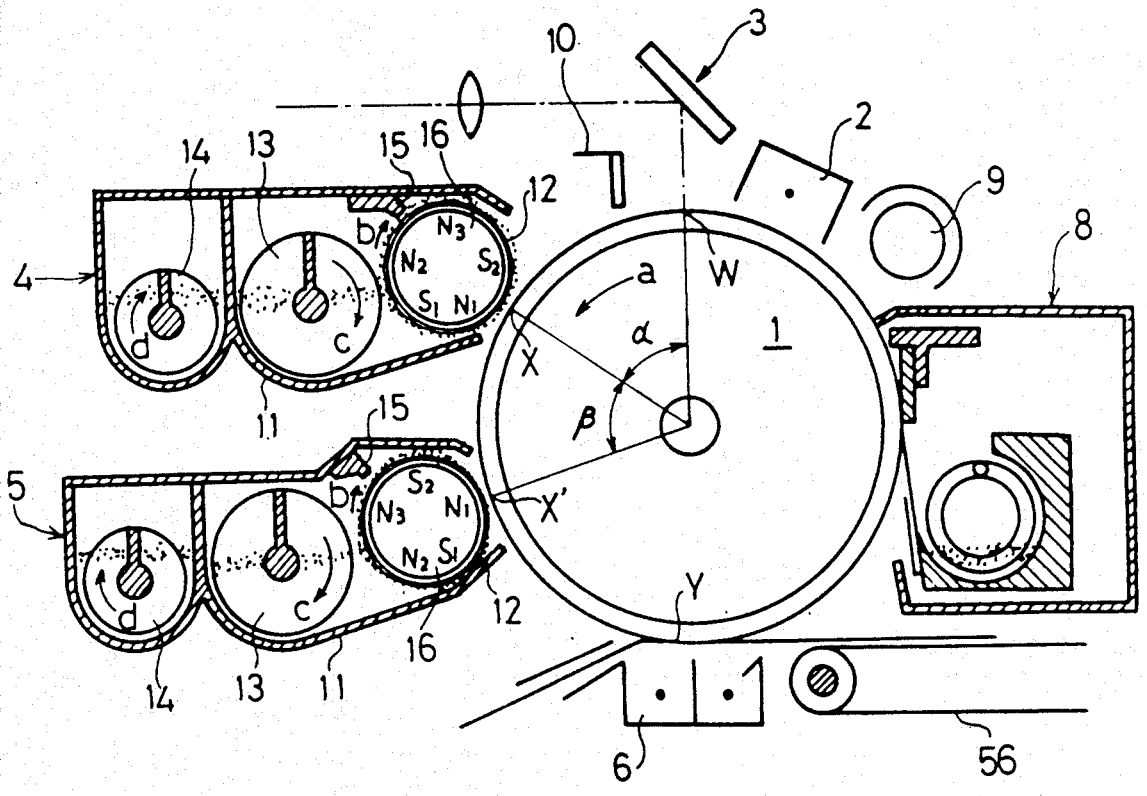

The first and second developing units 4,5 are made of substantially the same structure, and a developer tank 11, a developing sleeve 12, a feed roller 13 and a transport screw 14 are disposed sequentially from the side of photosensitive drum 1 as illustrated in FIG. 2. In the first developing unit 4, a developer composed of magnetic carrier and insulative colored toner is accommodated and in the second developing unit 5, a developer composed of magnetic carrier and insulative black toner, most generally used, is accommodated.

The developing sleeves 12 are made of non-magnetic electric conductive cylindrical members having fine concaves and convexes formed around its circumference and are disposed opposite to the photosensitive drum 1 at the transfer locations of X, X' having gaps for the transfer process thereat. The rotating angle from exposure point W to the developing locations X, X' are set as $\alpha$ and $\alpha+\beta$ respectively. At the back sides of the developing locations of the developing sleeves 12, height regulating members 15 are provided.

Inside the developing sleeves 12, magnet rollers 16 are disposed and are comprised of a plurality of magnets extending axially and the magnetic poles located around the circumferential surface of those magnets are arranged sequentially in the clockwise direction i.e. N1, S1, N2, N3 and S2, and magnetism is expressed by the relationship;

$$N_1 > S_1 = S_2 > N_2 = N_3$$

The magnet rollers 16 are arranged rotatable by a driving means (not shown) between the position where the magnetic pole $N_1$ faces the developing point and the position where the magnetic pole between $N_1$ and $S_2$ do not face the developing point. Accordingly, the developing units 4,5 are selectively used depending on whether the magnet rollers 16 are positioned for the transfer process or not.

The developing sleeves 12, feed rollers 13 and transport screws 14 are designed to rotate in the directions of b, c and d correlatively by a driving motor (not shown).

Figure 3:
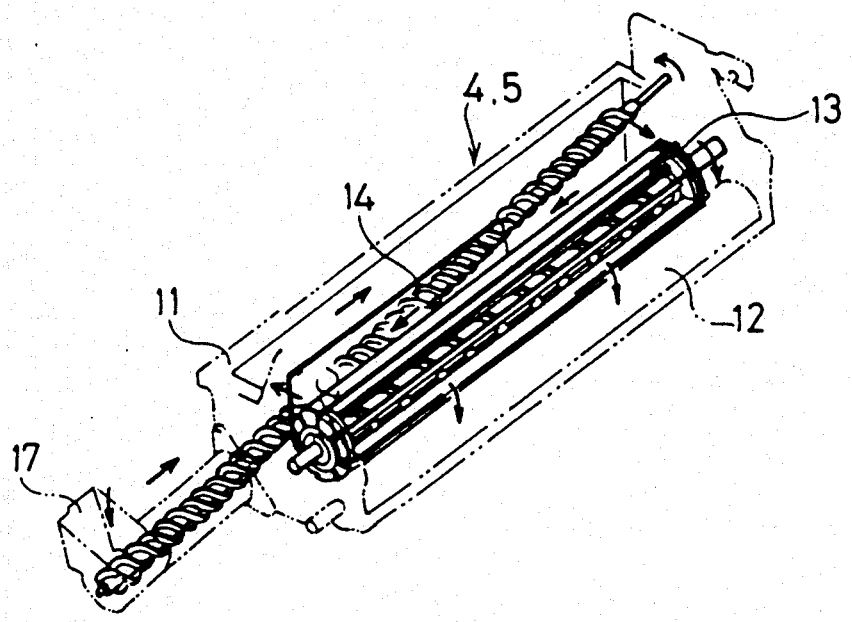
Figure 4:
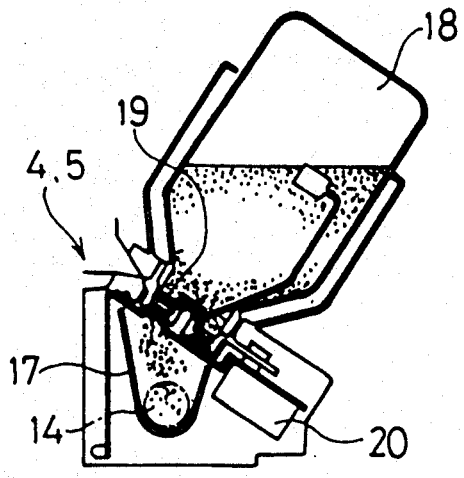

One end of the transport screw 14 is extended to a side portion of the developer tank 11 where toner receiving inlet 17 is provided as illustrated in FIGS. 3 and 4. The toner receiving portion 17 is designed to mount a toner bottle 18 thereon and toner is fed to the transport screw 14 by means of rotating toner discharge member 19 by toner feeding motor 20.

In the standard copying mode, unicolor developing process is carried out either by colored toner or by black toner depending on whether the electrostatic latent image being formed on the photosensitive drum 1 at the exposure point W is developed by the developing unit 4 upon reaching at the X position or by the developing unit 5 at the X' position. Any color, for example, red, blue, etc., may be selected according to requirements.

Figure 5:
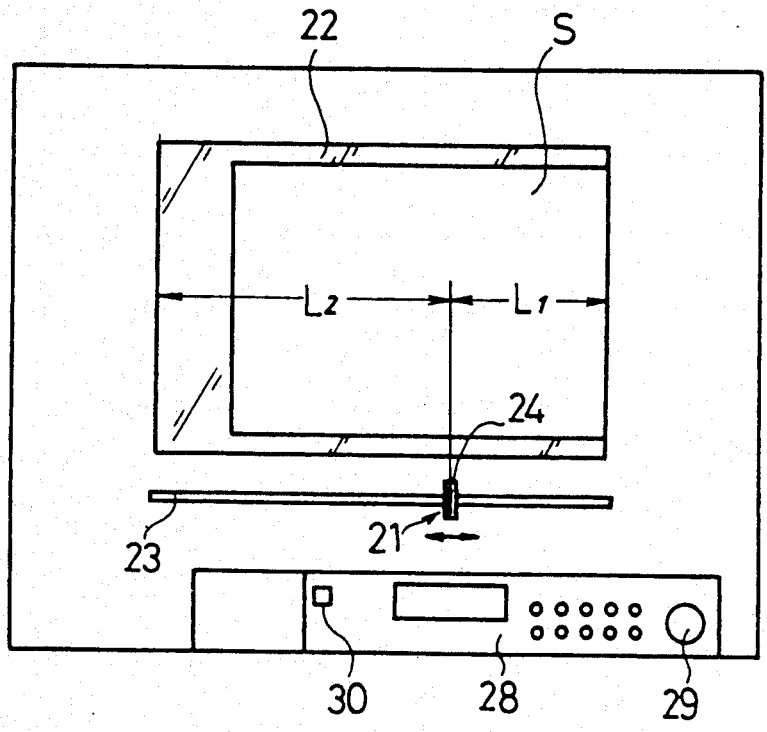
Figure 6:
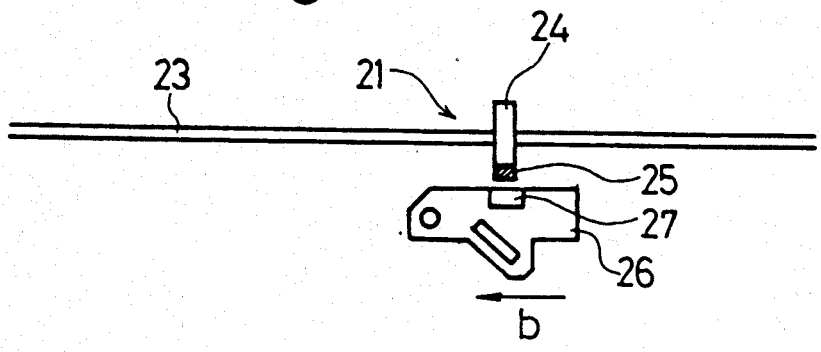

The copying machine herein disclosed is capable of carrying out a copying mode in which a copy in two different colors is obtainable (hereinafter called 1 scan 2 color copying mode) by selectively changing the developing units 4 or 5 according to the area scanned at a single scan operation for forming an image. Area designating mechanism 21 is, therefore, provided as shown in FIGS. 1, 5 and 6.

The area designating mechanism 21 will now be described with reference to FIGS. 5 and 6.

On a side of the document support glass 22, a guide groove 23 is provided along the scanning direction in which an area designating lever 24 is slidably disposed, and the document support plane is so arranged as to divide into two areas, L1 and L2, by positioning the level 24. Under the lever 24 located inside the copying machine, a magnet 25 is provided.

Figure 7:
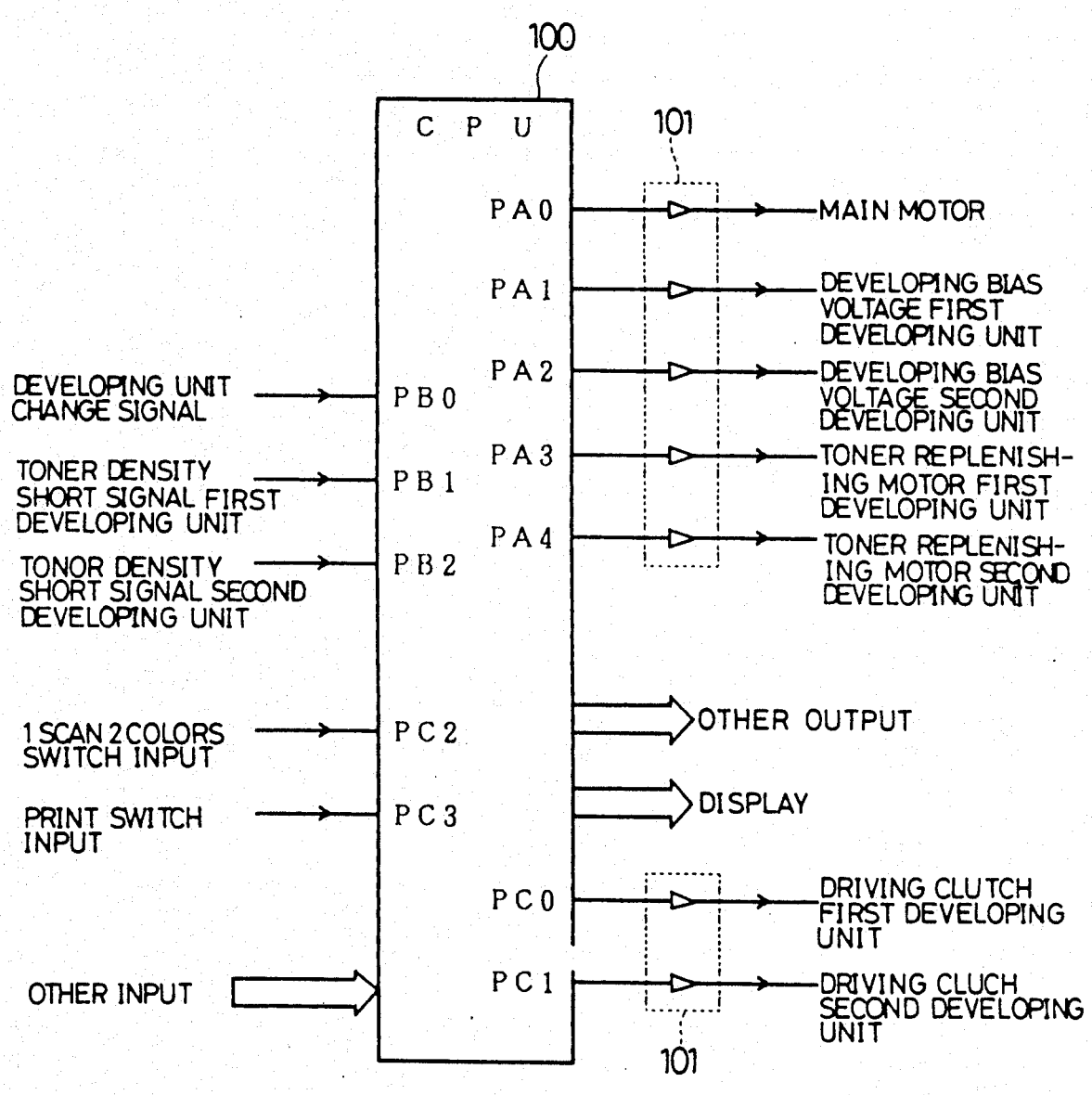

In a scanner 26 of the optical system, there is disposed a reed switch 27 which detects a signal from the magnet 25 and outputs a signal to microcomputer 100 for controlling the operation of copying machine shown in FIG. 7.

Designated by numeral 28 in FIG. 5 is an operation panel in which print switch 29 and 1 scan 2 color switch 30 are provided.

FIG. 7 is a control circuit diagram of the microcomputer 100 of the present embodiment. The microcomputer 100 is a 1 chip microcomputer which inputs various data related to the control of copying machine and outputs data to peripheral circuits. PA0, PA1, PA2, PA3 and PA4 in the output port of the microcomputer 100 control main motor, developing bias voltage of the first and second developing units 4,5 and toner replenishing motors of the first and second developing units 4,5. PC0 and PC1 in another output port control clutches for driving the developing units 4,5. Designated by 101 shows driving IC which controls developing bias voltages and toner replenishment motors for the first and second development units.

Into PB0 thru PB2 in the input port of the microcomputer 100, developing unit change signals and toner density short signals emitted from toner density detection means of the first and second developing units are inputted, respectively. Into PC2 and PC3 in another input port, the signals from 1 scan 2 color switch 30, print switch 29 both of which are in the operation panel 28 are inputted.

1 scan 2 color copying will be hereinafter described. When the main switch of the copying machine is turned on, the middle part between the magnetic poles of S2 and N1 in the developing unit 4 is positioned opposite to the photosensitive drum 1, and the magnetic pole N1 in the developing unit 5 is positioned opposite to the photosensitive drum 1 respectively ready for developing process. When print switch 29 is turned on under such condition, the second developing unit 5 which accommodates black toner automatically start driving and standard copying operation is carried out.

On the other hand, when 1 scan 2 color switch 30 is turned on, the copying mode is changed to 1 scan 2 color copying mode which places the first developing unit 4 in operation and the second developing unit 5 becomes non-operational. At the same time, it becomes possible to designate an area to be copied by the area designation lever 24. An area is then designated by the lever 24 after placing a document S on the document support glass 22 as shown in FIG. 5.

Next, when the print switch 29 is turned on, the developing sleeve 12, the feed roller 13 and the transport screw 14 in the first developing unit 4 start rotating in the directions of the arrows b, c and d respectively by driving motors, and the first developing unit 4 starts operation. The scanner 26 then starts operation and the document S placed on the document glass 22 is illuminated and an electrostatic latent image is formed on the surface of the photosensitive drum 1, thereafter development by colored toner starts in the first developing unit 4 which is in operation.

At the time when the magnet 25 in the area designation lever 24 is detected by the reed switch 27 of the scanner 26, the electrostatic latent image in the boundary portion of the two areas L1 and L2 is positioned at the exposure point W. Accordingly, the first developing unit 4 is kept operational until the electrostatic latent image in the boundary portion moves to the developing position X of the first developing unit, and then, the unit 4 stops operation. Thereafter, the second developing unit 5 starts operation when the electrostatic latent image reached the developing position X' of the second developing unit 5 which corresponds to the area L2, and black toner is supplied to the electrostatic latent image corresponding to the area L2 and development in black and white is carried out until scanning is finished.

Figure 9:
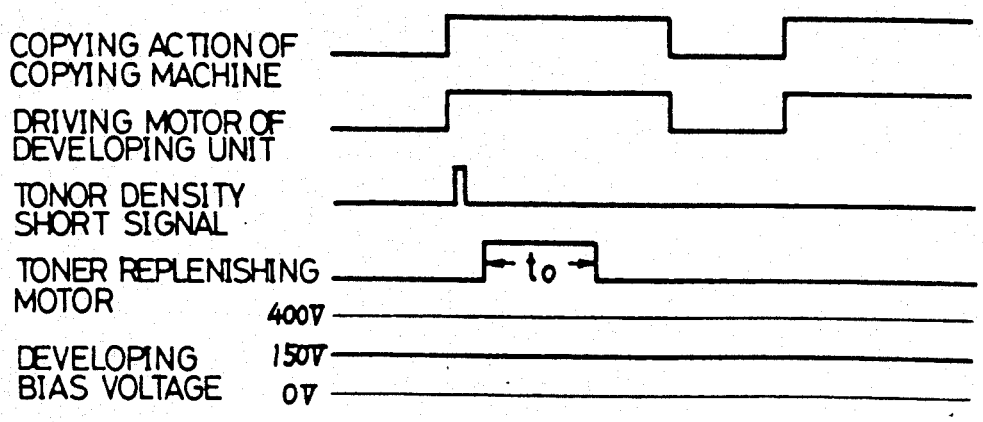

In the standard copying mode described above, in a case when a toner density short signal is emitted from the toner density detecting means provided in the second developing unit 5, as shown in FIG. 9, the toner replenishing motor 20 starts operation for a predetermined time to operate only within the operating time of the driving motor in the developing unit 5, and the toner replenished is supplied into the developer tank 11 uniformly since the transport screw 14 and feed roller 13 are kept in action.

Figure 8:
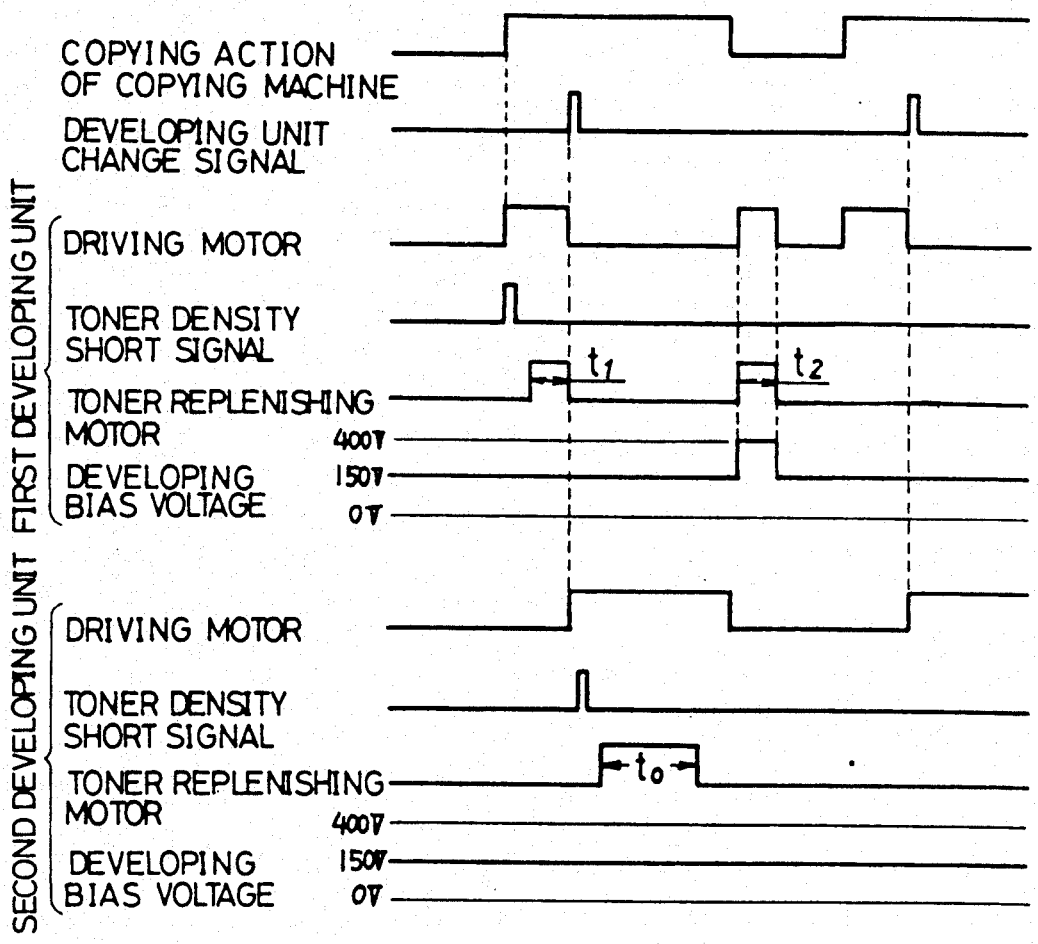

On the other hand, in the 1 scan 2 color copying mode, in the case when a toner density short signal is emitted when the first developing unit 4 is in action, as illustrated in FIG. 8, the toner replenishing motor starts operating and toner is replenished for a predetermined time $t_1$ only within the time until the first developing unit 4 stops its action.

When toner is replenished within the operating time of the first developing unit 4, it may cause a shortage of toner in the developer tank 11 resulting in a lowering of image density as toner consumption may exceed the amount of toner being replenished.

Especially when 1 scan 2 color copying is carried out, the first area, L1, tends to be occupied by large letters used for titles, and the area occupied by those large letters becomes relatively larger than the area occupied by ordinary letters. For instance, the are occupied by ordinary letters is generally estimated about 7% on the average while the portion occupied by such large letters occupies more than 20% thus consuming larger amount of toner. However, the area occupied by the title portion generally covers not more than 70 mm, and if a regular amount of toner is positively replenished, toner supply is sufficient enough for ordinary copying operation.

Then, the second developing unit 5 starts action, and in case a toner density short signal is emitted, the toner replenishing motor 20 starts operation for toner replenishment. Toner replenishment will be finished if the time necessary for replenishing sufficient toner is within the operating time of the second developing unit 5 after the toner density short signal is emitted.

After the second developing unit 5 has stopped its action and the copying operation is over, toner supply is carried out prior to next copying operation in the first developing unit 4 in order to replenish the toner consumed, for which the toner replenishing motor 20 is actuated for the time $t_2$ and the time $t_0 = t_1 + t_2$ necessary for toner replenishment is secured. At the same time, the driving motor in the developing unit 4 starts action for rotatively driving the transport screw 14 and feed roller 13 thus preventing the toner supplied to toner receiving inlet 17 from overflowing.

Larger voltage of 400 V than 150 V which is normally applied as developing bias voltage in the developing process is impressed thus eliminating unnecessary toner adhesion to the photosensitive drum 1. Conversely, the developing bias voltage may be decreased, and such means as turning off the charger 2 or lowering the surface voltage of the photosensitive drum 1 by utilizing the exposure lamp and suberaser 10 may also be applied.

In the embodiment described above, an example is shown in which the first area L1 is developed by the first developing unit 4 and the second area L2 by the second developing unit 5. However, it may be arranged to optionally combine area and developing unit by providing a selective switch.

A dual component developer composed of magnetic carrier and toner is introduced in the embodiment, however, a developer of single component may also be applicable. For detecting the shortage of toner when dual component developer is used, a means for detecting the toner density according to variation of magnetic permeability is preferably utilized, however, toner density detecting means for detecting practical toner density on the photosensitive drum may also be utilized.

Figure 10:
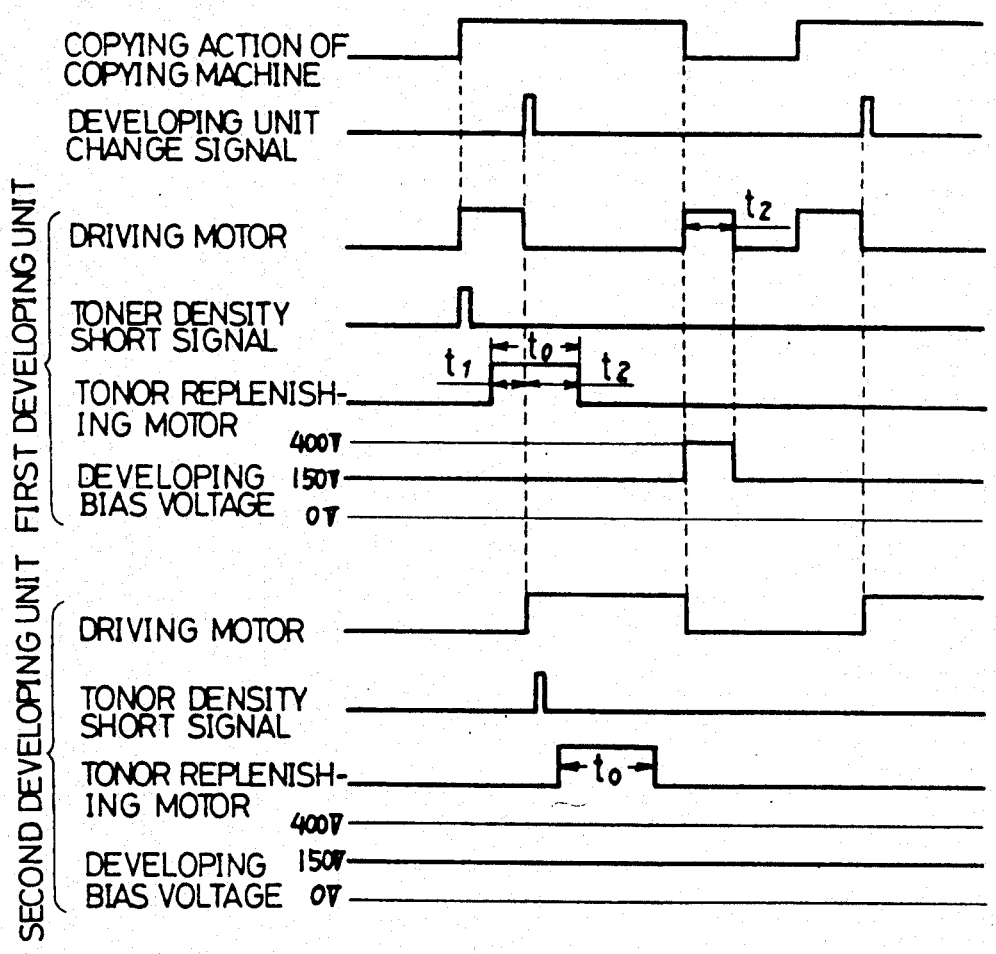
FIG. 10 is a time chart for movement of each part during 1 scan 2 colors copying mode in another embodiment of the present invention.

FIG. 10 illustrates a time chart of 1 scan 2 color mode in the second embodiment of the present invent. The difference between the first embodiment is in the timing of toner replenishing motor, which will be described below.

In the 1 scan 2 color copying mode, when a toner density short signal is output while the first developing unit 4 is in action, toner replenishing motor 20 starts operation for toner replenishment for predetermined time $t_o$ exceeding the time $t_1$ the first developing unit 4 comes to stop its operation as shown in the figure.

The second developing unit 5 then starts action, and when a toner density short signal is output, toner replenishing motor 20 starts operation for toner replenishment. Toner supply can be completed when the time necessary for toner replenishment $t_o$ is within the operating time of the second developing unit 5.

Prior to the next copying operation after the second developing unit 5 stopped its action and copying operation is over, the driving motor of the first developing unit 4 starts action for the time $t_2$ only ($t_2 = t_0 - t_1$) which is the difference between the predetermined time $t_0$ and the time the first developing unit 4 and toner replenishing motor 20 started operation $t_1$, and the transport screw 14 and feed roller 13 are rotatively driven thereby feeding the toner accumulated in the toner receiving inlet 17 to the developer tank 11 uniformly so that no toner overflows the tank.

What is claimed is:

1. An image forming apparatus provided with a plurality of developing means for developing an image of an original in a plurality of colors by sequentially actuating a plurality of the developing means, comprising:

a plurality of developer replenishing means each of which corresponds to one of a plurality of the developing means and replenishes developer to each corresponding developing means;

detecting means for detecting a shortage of developer in each of the developing means;

first control means, responsive to the detecting means, for actuating one of the developer replenishing means corresponding to the developing means in operation, said first control means continuing the actuating of said one of the developer replenishing means even after said corresponding developing means ceases operation; and second control means for actuating the developing means receiving developer replenishment when the developing means ceased operation in response to said first control means for a predetermined time after the development of the image of original is completed.

2. An image forming apparatus which is provided with a plurality of developing means capable of developing an image of an original in a plurality of colors by sequentially actuating a plurality of the developing means, comprising:

a plurality of developer replenishing means each of which corresponds to one of a plurality of developing means and replenishes developer to each corresponding developing means;

detecting means for detecting a shortage of developer in each of the developing means;

first control means, responsive to the detecting means, for actuating one of the developer replenishing means corresponding to the developing means in operation, said first control means suspending the actuating of said one of the developer replenishing means when said corresponding developing means ceases operation; and second control means operable after development of the image of the original is completed for reactuating the developer replenishing means suspended by said first control means, whereby developer is replenished to said one of developing means.

3. An image forming apparatus which is provided with a plurality of developing means capable of developing an image of an electrostatic latent image formed on a photo-sensitive drum in a plurality of colors by sequentially actuating a plurality of the developing means, comprising:

a plurality of developer replenishing means, each replenishing means corresponding to one of a plurality of the developing means and a developer is replenished to each corresponding developing means;

a detecting means for detecting a shortage of developer in each of the developing means;

a first control means, responsive to the detecting means, for actuating one of the developer replenishing means corresponding to the developing means in operation, said first control means suspending actuating of said one of the developer replenishing means when said corresponding developing means stops operation; and a second control means operable after development of the electrostatic latent image is completed for reactuating the developer replenishing means suspended by said first control means, whereby developer is replenished to said one of said developing means.

4. An image forming apparatus as claimed in claim 3, further comprising:

support means for supporting an original document thereon;

scanning means for scanning the original document and projecting the scanned image of the original document to the photosensitive drum;

means for generating a changeover signal at a predetermined time during the scanning operation; and means for initially operating said one of the developing means, and stopped operation of said one of the developing means and operating another of the developing means in response to the changeover signal.

5. An image forming apparatus provided with a plurality of developing means capable of developing an image of an electrostatic latent image formed on a photosensitive drum in a plurality of colors by sequentially actuating a plurality of the developing means, comprising:

a plurality of developer replenishing means, each replenishing means corresponding to one of a plurality of the developing means to replenish developer to each corresponding developing means;

detecting means for detecting a shortage of developer in each of the developing means;

first control means, responsive to the detecting means, for actuating one of the developer replenishing means corresponding to the developing means in operation, said first control means continuing said actuating of said one of the developer replenishing means even after said corresponding developing means ceases operation; and second control means for actuating one of said plurality of developing means which received the developer replenishment when said developing means was not in operation for a predetermined time after development of the electrostatic latent image is completed.

* * * * *